US009701123B2

(12) United States Patent
Naoe

(10) Patent No.: US 9,701,123 B2
(45) Date of Patent: Jul. 11, 2017

(54) INKJET PRINTING APPARATUS

(71) Applicants: SCREEN Holdings Co., Ltd., Kyoto-shi, Kyoto (JP); Ricoh Company, Ltd., Tokyo (JP)

(72) Inventor: Ryoichi Naoe, Kyoto (JP)

(73) Assignees: SCREEN HOLDINGS CO., LTD., Kyoto (JP); RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/911,437

(22) PCT Filed: Apr. 7, 2014

(86) PCT No.: PCT/JP2014/060122
§ 371 (c)(1),
(2) Date: Feb. 10, 2016

(87) PCT Pub. No.: WO2015/022788
PCT Pub. Date: Feb. 19, 2015

(65) Prior Publication Data

US 2016/0193841 A1 Jul. 7, 2016

(30) Foreign Application Priority Data

Aug. 12, 2013 (JP) ..... 2013-167650

(51) Int. Cl.
*B41J 2/165* (2006.01)

(52) U.S. Cl.
CPC ..... *B41J 2/16535* (2013.01); *B41J 2/16508* (2013.01); *B41J 2/16538* (2013.01); *B41J 2/16541* (2013.01); *B41J 2/16585* (2013.01); *B41J 2/16505* (2013.01); *B41J 2/16547* (2013.01)

(58) Field of Classification Search
None
See application file for complete search history.

(56) References Cited

U.S. PATENT DOCUMENTS

2002/0163552 A1* 11/2002 Takahashi ..... B41J 2/16544 347/33
2008/0278538 A1* 11/2008 Tokuno ..... B41J 2/16538 347/33
2012/0194607 A1 8/2012 Iwasa et al.

FOREIGN PATENT DOCUMENTS

JP 07-214787 A 8/1995
JP 09-156115 A 6/1997
(Continued)

OTHER PUBLICATIONS

Wikipedia Article "Hygroscopy", Paragraph 1, retrieved from the Internet Google Search on [May 30, 2016].*
(Continued)

*Primary Examiner* — Lisa M Solomon
(74) *Attorney, Agent, or Firm* — McDermott Will & Emery LLP

(57) ABSTRACT

A wiper cleaner unit moves a wiper-off part to a capping position orthogonally relative to a direction in which inkjet heads are disposed in synchronization with movement of a cap holder, thereby wiping off wiper blades in a standby position orthogonally relative to the direction in which the inkjet heads are disposed. This allows the wiper-off part to clean the wiper blades off ink droplets. Consequently, cleaning unevenness of a print unit due to the wiper blades is avoidable.

12 Claims, 9 Drawing Sheets

(56) References Cited

FOREIGN PATENT DOCUMENTS

| | | | |
|---|---|---|---|
| JP | 2006-27002 | A | 2/2006 |
| JP | 2011-156755 | A | 8/2011 |
| JP | 2012-157989 | A | 8/2012 |

OTHER PUBLICATIONS

International Search Report PCT/JP2014/060122 dated Jul. 1, 2014 with English translation.

* cited by examiner

INKJET PRINTING APPARATUS

CROSS-REFERENCE TO RELATED APPLICATIONS

The subject application is the U.S. National Phase of PCT/JP2014/060122 filed Apr. 7, 2014, which claims priority to Japanese Patent Application No. 2013-167650 filed Aug. 12, 2013. The subject matter of each is incorporated herein by reference in entirety.

TECHNICAL FIELD

The present invention relates to an inkjet printing apparatus that discharges ink droplets while moving a print medium and a printing head relatively to each other for printing characters or images to the print medium. More particularly, the present invention is directed to a technique of surroundings of wiper blades that wipe off nozzles of the printing head individually.

BACKGROUND ART

Examples of such a currently-used apparatus include an apparatus as under. That is, the apparatus is provided with a printing head with a plurality of inkjet heads, a cap unit, and wiper blades. The cap unit moves orthogonally relative to a direction in which the inkjet heads are arranged between a capping position where nozzles of the inkjet heads are each closed and a standby position where the nozzles are opened. The wiper blades move in the direction in which the inkjet heads are arranged when the cap unit is in the standby position for wiping off the nozzles individually. See, for example, Patent Literature 1: Japanese Unexamined Patent Publication No. 2012-157989A.

The inkjet printing apparatus performs printing onto a printing sheet by discharging ink droplets. Such an inkjet printing apparatus typically performs purge periodically by sucking or pressurizing all the nozzles of the printing head in order not to make any non-discharging nozzles caused by ink droplets with high viscosity. Accordingly, ink droplets accumulate on a discharge surface of the printing head with outlets of all the nozzles being opened. Then the wiper blades wipe off the discharge surface of the printing head while the cap unit is moved to the standby position. This achieves removal of the ink droplets accumulating on the discharge surface of the printing head.

PATENT LITERATURE

Patent Literature 1: Japanese Patent Publication No. 2012-157989A

SUMMARY OF INVENTION

Technical Problem

However, the example of the currently-used apparatus with such constructions has the following drawback. That is, in the currently-used apparatus, ink droplets stay adhering to the wiper blades after the discharge surface of the printing head is wiped off. If the wiper blades are left with the ink droplets adhering thereto, the ink droplets solidify on the wiper blades. Accordingly, the ink droplets accumulate on the wiper blades after several-time wiping, possibly leading to irregularities on the wiper blades. Under such a condition, the wiper blades perform wiping unevenly, resulting in cleaning unevenness to the discharge surface of the printing heads. Here in the currently-used apparatus, cleaning the wiper blades every few days is required for prevention of the cleaning unevenness mentioned above. This causes more time and effort for maintenance of the apparatus. As a result, the apparatus may possibly have lowered availability.

The present invention has been made regarding the state of the art noted above, and its one object is to provide an inkjet printing apparatus that allows prevention of cleaning unevenness of a printing head caused by wiper blades by cleaning the wiper blades.

Solution to Problem

The present invention is constituted as stated below to achieve the above object. One aspect of the present invention provides an inkjet printing apparatus that discharges ink droplets to a print medium for printing. The inkjet printing apparatus includes a printing head that has a plurality of inkjet heads disposed in a direction orthogonal to a transportation direction in which the printing head is moved relatively to the print medium, and discharges the ink droplets from discharge surfaces of the inkjet heads to the print medium individually for the printing; a cap unit movable in the transportation direction between a capping position for closing a discharge surface of the printing head and a standby position for opening the discharge surface of the printing head; a wiper unit that has wiper blades in a direction orthogonal to a direction in which the inkjet heads are disposed, and moves from the standby position, spaced away from the printing head, in the direction in which the inkjet heads are disposed for wiping off the discharge surfaces of the inkjet heads with the wiper blades; and a wiper cleaner unit provided with a wiper-off part that wipes off the wiper blades in the standby position orthogonally relative to the direction in which the inkjet heads are disposed by moving orthogonally relative to the direction in which the inkjet heads are disposed in synchronization with movement of the cap unit to the capping position.

[Operation and Effect] With the aspect of the present invention, the wiper-off part is moved orthogonally to the direction in which the inkjet heads are disposed in synchronization with the movement of the cap unit to the capping position. Accordingly, the wiper blades in the standby position are wiped off orthogonally relative to the direction in which the inkjet heads are disposed. This causes the wiper-off part to clean the wiper blades off the ink droplets. Consequently, cleaning unevenness of the printing head due to the wiper blades is avoidable.

It is preferred in the aspect of the present invention that the wiper cleaner unit is coupled to the cap unit.

The wiper cleaner is brought into synchronization with the movement of the cap unit from the standby position to the capping position. This needs no drive unit for the wiper cleaner unit. As a result, a simple configuration is achieved for reduction in apparatus cost.

Moreover, it is preferred that the inkjet printing apparatus according to the aspect of the present invention further includes a wiper cleaner unit driving device that drives the wiper-off part in such a way to wipe in the direction in which the inkjet heads are disposed, and that the wiper cleaner unit driving device operates by the movement of the cap unit to the capping position.

Here, the wiper cleaner unit driving device drives the wiper-off part. Accordingly, a wiping timing with the wiper-off part is adjustable to a desired timing when the cap unit is moved to the capping position.

It is preferred in the aspect of the present invention that the wiper-off part includes a slit slightly narrower than a thickness of the wiper blades in the direction in which the inkjet heads are disposed, and the slit squeezes the wiper blades.

The slit squeezes the wiper blades, thereby removing the ink droplets adhering to the wiper blades. This results in a simple configuration of the wiper-off part, and thus reduction in apparatus cost.

It is preferred in the aspect of the present invention that the wiper-off part includes a pair of rotary rollers into which the wiper blades are interposed in the direction in which the inkjet heads are disposed, and the pair of rotary rollers wipes off the wiper blades.

A pair of rotary rollers wipes off the wiper blades. This yields removal of the ink droplets with low contact resistance to the wiper blades. Consequently, both the wiper blades and the wiper-off part are worn less, achieving reduction in frequency for maintenance.

Moreover, it is preferred in the aspect of the present invention that the wiper-off part is made of a hygroscopic material that absorbs the ink droplets discharged from the inkjet heads.

The wiper-off part made of the hygroscopic material absorbs the ink droplets. This ensures to remove the ink droplets from the wiper blades and to prevent the apparatus from contamination due to drop off of the ink droplets from the wiper-off part from which the ink droplets are removed.

Advantageous Effects of Invention

With the inkjet printing apparatus according to the aspect of the present invention, the wiper cleaner unit moves the wiper-off part orthogonally relative to the direction in which the inkjet heads are disposed in synchronization with the movement of the cap unit to the capping position. This causes the wiper blades in the standby position to be wiped off orthogonally relative to the direction in which the inkjet heads are disposed. Accordingly, the wiper-off part can clean the wiper blades off the ink droplets, resulting in prevention of cleaning unevenness of the printing head due to the wiper blades is avoidable.

DESCRIPTION OF EMBODIMENTS

Figure 1:
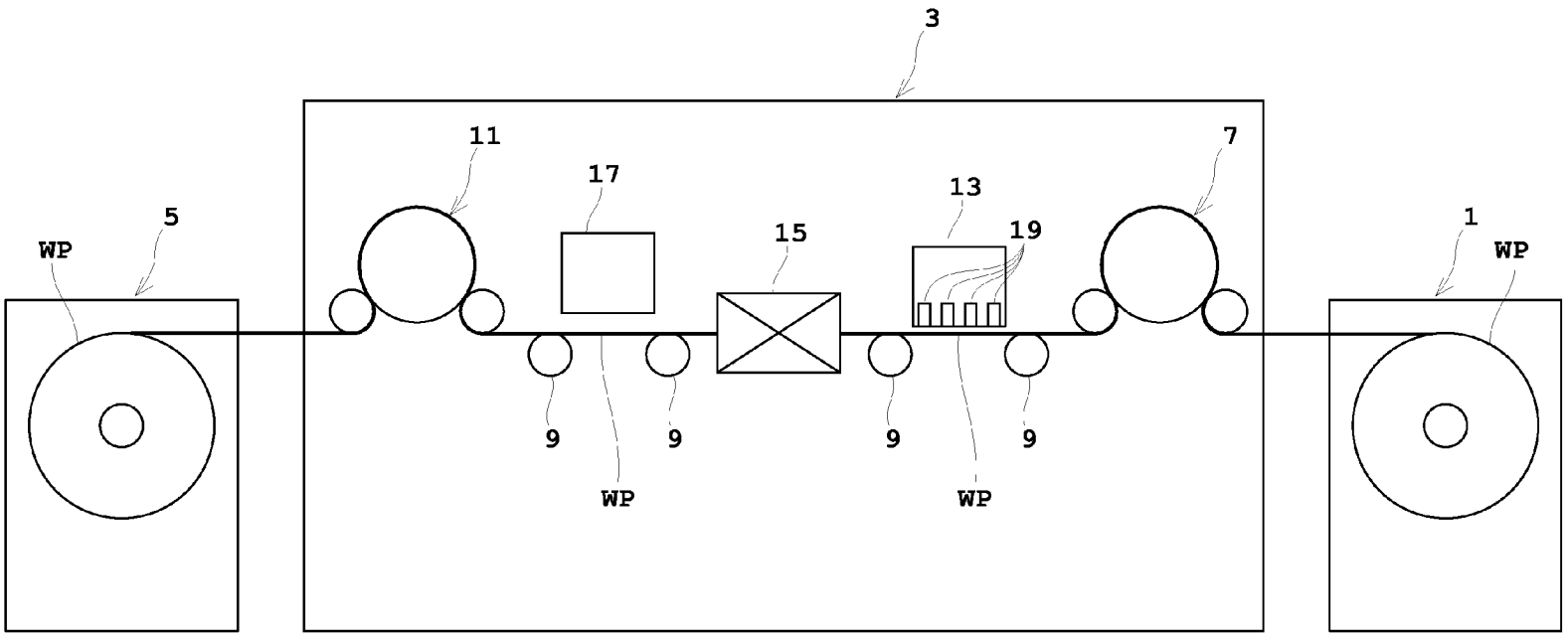
FIG. 1 schematically illustrates an overall configuration of an inkjet printing system according to one embodiment of the present invention.

The following describes one embodiment of the present invention with reference to drawings. FIG. 1 schematically illustrates an overall configuration of an inkjet printing system according to the embodiment.

The inkjet printing system according to one embodiment of the present invention includes a paper feeder 1, an inkjet printing apparatus 3, and a take-up roller 5.

The paper feeder 1 holds the web paper WP in a roll form to be rotatable about a horizontal axis. The paper feeder 1 unwinds and feeds the web paper WP to the inkjet printing apparatus 3. The take-up roller 5 winds up the web paper WP printed by the inkjet printing apparatus 3 about a horizontal axis. Regarding the side from which the web paper WP is fed as upstream and the side to which the web paper WP is fed out as downstream, the paper feeder 1 is disposed upstream of the inkjet printing apparatus 3, whereas the take-up roller 5 is disposed downstream of the inkjet printing apparatus 3.

The inkjet printing apparatus 3 includes a drive roller 7 upstream thereof for taking in the web paper WP from the paper feeder 1. The web paper WP unwound from the paper feeder 1 by the drive roller 7 is transported downstream toward the take-up roller 5 along a plurality of transport rollers 9. A drive roller 11 is disposed between the most downstream transport roller 9 and the take-up roller 5. The drive roller 11 feeds the web paper WP travelling on the transport rollers 9 toward the take-up roller 5.

Between the drive rollers 7 and 11, the inkjet printing apparatus 3 includes a print unit 13, a drier 15, and an inspecting unit 17 arranged in this order from upstream. The drier 15 dries portions printed by the print unit 13. The inspecting unit 17 inspects the printed portions for any stains or omissions.

The print unit 13 has a plurality of inkjet heads 19 for discharging ink droplets. A plurality of print units 13 is typically disposed along the transportation direction of the web paper WP. For instance, four print units 13 are provided separately for black (K), cyan (C), magenta (M), and yellow (Y). However, in order to facilitate understanding of the present invention, the following description will be given on the assumption that only one printing unit 13 is provided. Moreover, the print unit 13 includes the inkjet heads 19 in a direction orthogonal to the transportation direction of the web paper WP. The print unit 13 has enough inkjet heads 19 to perform printing without moving over a printing area in the width direction of the web paper WP. That is, the inkjet printing apparatus 3 in the present embodiment performs printing on the web paper WP being fed thereto, with the inkjet heads 19 not moving for primary scanning but remaining stationary in the direction orthogonal to the transport direction of the web paper WP.

The print unit 13 corresponds to the "printing head" in the present invention.

Figure 2:
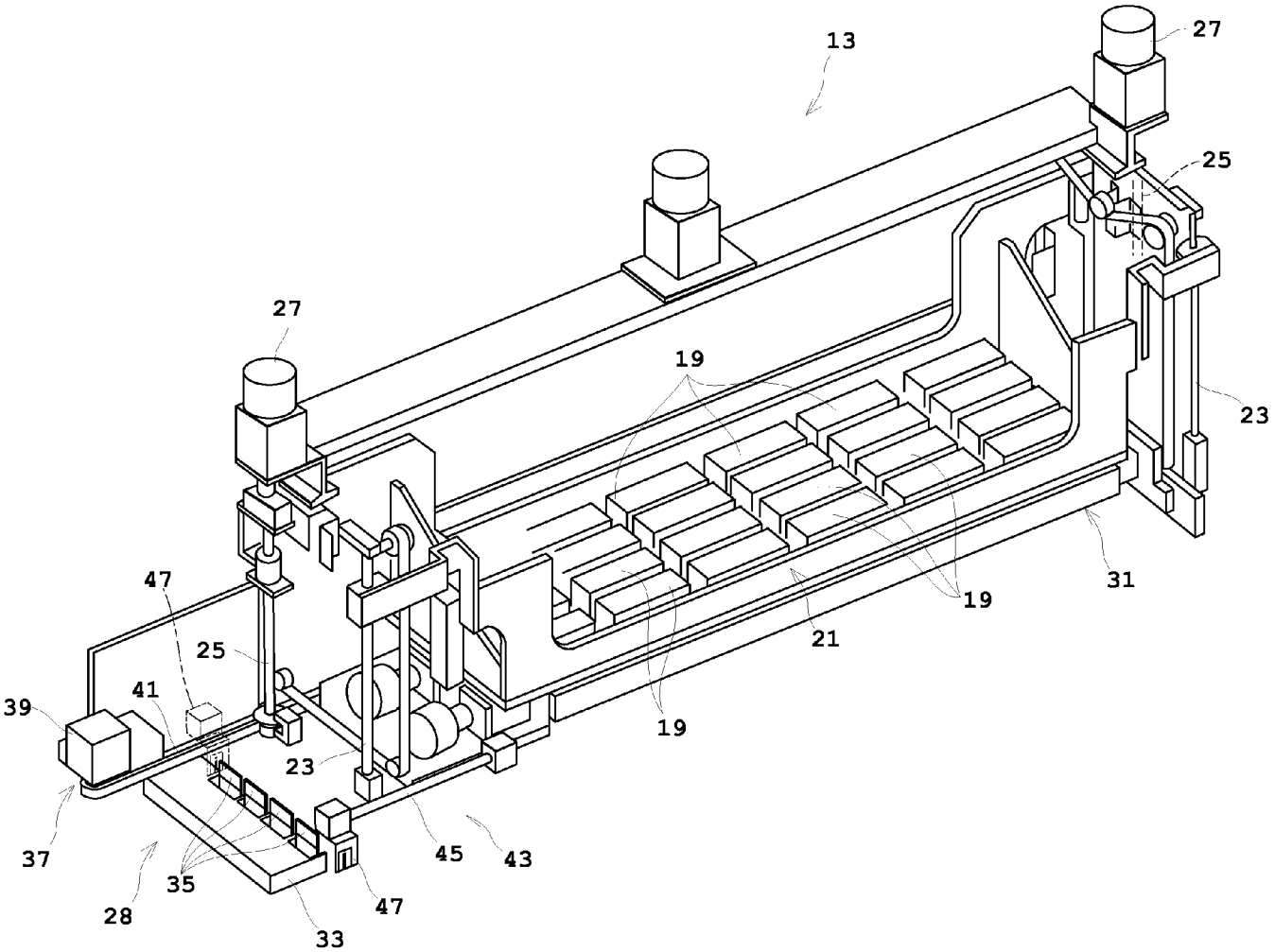
FIG. 2 is a perspective view of a print unit.
Figure 3:
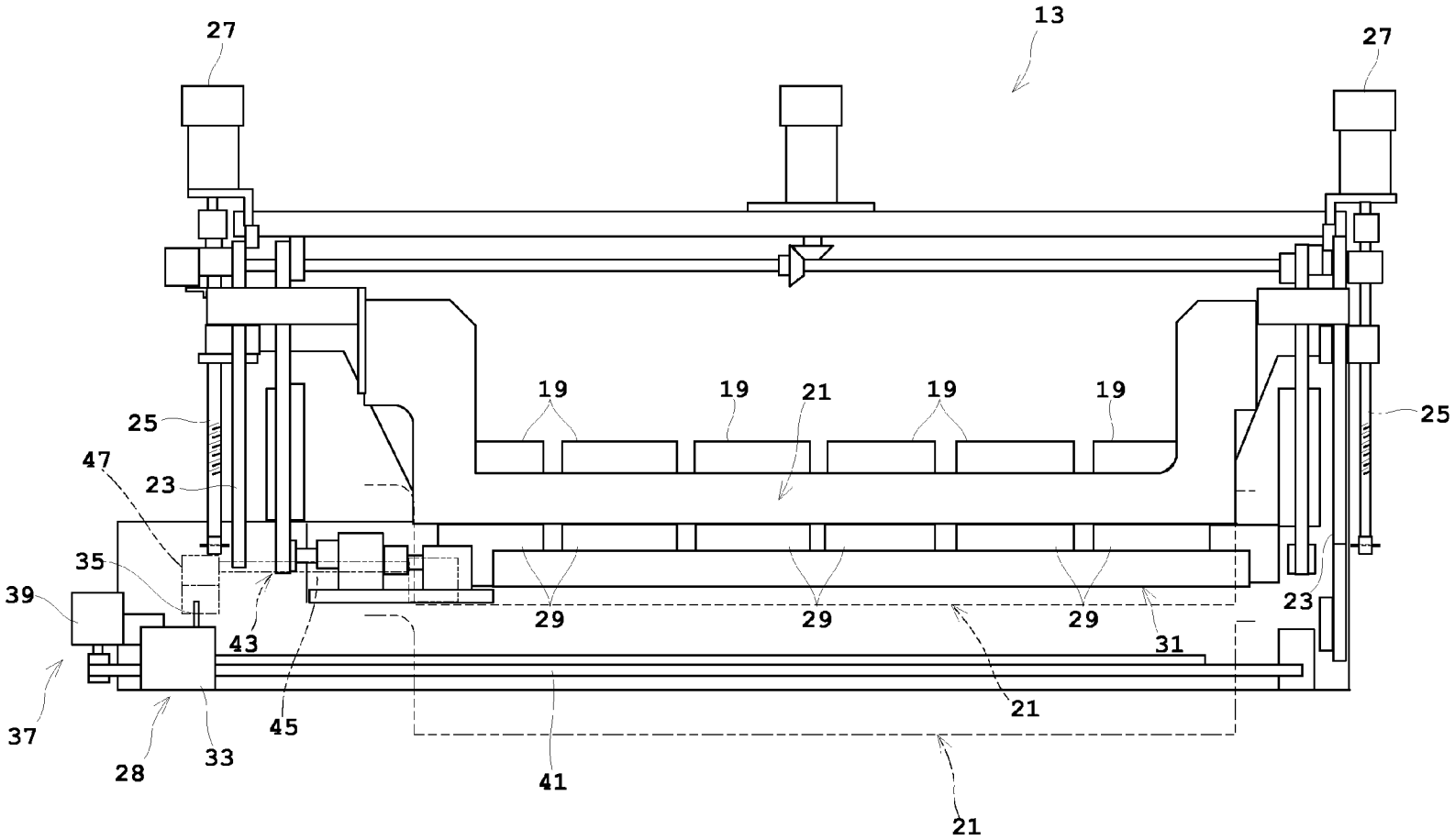
FIG. 3 is a front view of the print unit.

Here, the following describes the above print unit 13 in detail with reference to FIGS. 2 and 3. FIG. 2 is a perspective view of the print unit. FIG. 3 is a front view of the print unit.

The print unit 13 of the present embodiment includes twenty-four inkjet heads 19 and an inkjet head holder 21 holding the inkjet heads 19 collectively. The inkjet head holder 21 holds the twenty-four inkjet heads 19 while six of the twenty-four inkjet heads 19 are arranged in one row orthogonally relative to the transportation direction of the web paper WP and four rows are arranged in the transportation direction of the web paper WP. The inkjet heads 19 each pass through a bottom of the inkjet head holder 21 to discharge ink droplets from a lower surface of the inkjet head holder 21 to the web paper WP. The number of inkjet heads 19 of the inkjet head holder 21 is not limited by twenty-four as in the present embodiment.

Linear guides 23 are disposed substantially vertically on both sides of the inkjet head holder 21 (a width direction of the web paper WP). The linear guides 23 are paired, and guide and hold the inkjet head holder 21 liftably. Moreover, a pair of right and left ball screws 25 is disposed on both right and left sides of the inkjet head holder 21 substantially vertically. The inkjet head holder 21 is threadably mounted on the pair of ball screws 25 via nuts not shown. A pair of motors 27 on both upper right and left sides of the inkjet head holder 21 rotatably drives the pair of ball screws 25, respectively, around a vertical axis. Consequently, operation of the paired motors 27 causes the inkjet head holder 21 to move vertically.

The inkjet head holder 21 is moved vertically among three levels, i.e., a "capping position" denoted by solid lines in FIG. 3, a "wiper position" denoted by dotted lines in FIG. 3, and a "printing position" denoted by chain double-dashed lines in FIG. 3. In the wiper position, a wiper unit 28 illustrated on the left of FIGS. 2 and 3 is moved horizontally along the inkjet heads 19, whereby ink droplets or foreign substances adhering to the discharge surfaces of the inkjet heads 19 are wiped off.

The print unit 13 includes twenty-four caps 29 disposed correspondingly to the twenty-four inkjet heads 19. The caps 29 individually close surroundings of the discharge surfaces of the inkjet heads 19 having the opened ink outlets. The caps 29 prevent drying and contamination around the ink outlets of the inkjet heads 19. The caps 29 are held with a cap holder 31.

The cap holder 31 is movable between two positions while holding the caps 29. The two positions are the "capping position" below the inkjet head holder 21 as in FIG. 3, and a "standby position" behind the inkjet head holder 21 along the back face in side view (i.e., farther from the viewer in FIG. 3). Here in FIGS. 2 and 3, the standby position is omitted.

The caps 29 and the cap holder 31 correspond to the "cap unit" in the present invention.

The wiper unit 28 is provided with a base 33, four wiper blades 35, and a wiper drive unit 37.

The base 33 are elongated in the transportation direction of the web paper WP. The base 33 has the four wiper blades 35 disposed thereon on a side adjacent to the inkjet heads 19 linearly in the transportation direction in plan view. The wiper blades 35 are each sheeted resin. The wiper blades 35 are wide in the transportation direction of the web paper WP, and are thin in the width direction of the web paper WP. The base 33 has a proximal end (adjacent to the back face of the inkjet heads 19) on which a wiper drive unit 37 is disposed. The wiper drive unit 37 includes a motor 39 and a timing belt 41. The timing belt 41 is arranged along lower surfaces of the inkjet heads 19 in the wiper position from a side adjacent to the motor 39 to a side opposite thereto across the transportation direction of the web paper WP. The timing belt 41 is suspended between a rotary shaft of the motor 39 and a pulley (not shown) on an opposite side across the transportation direction of the web paper WP. The base 33 is fixed partially on the timing belt 41. Consequently, driving the motor 39 causes the wiper blades 35 to move along the lower surfaces of the inkjet heads 19 in the width direction of the web paper WP, thereby wiping off ink droplets or foreign substances adhering on the discharge surfaces of the inkjet heads 19. FIGS. 2 and 3 each illustrate the position of the wiper unit 28 as the "standby position".

The cap holder 31 includes a wiper cleaner unit 43 adjacent to the wiper unit 28. The wiper cleaner unit 43 includes a coupling member 45 and a wiper-off part 47. The coupling member 45 has a first end face fixed on the cap holder 31. The coupling member 45 extends from the cap holder 31 toward the wiper unit 28 disposed in a width direction of the web paper WP. The coupling member 45 has a second end face to which the wiper-off part 47 is attached.

Figure 4:
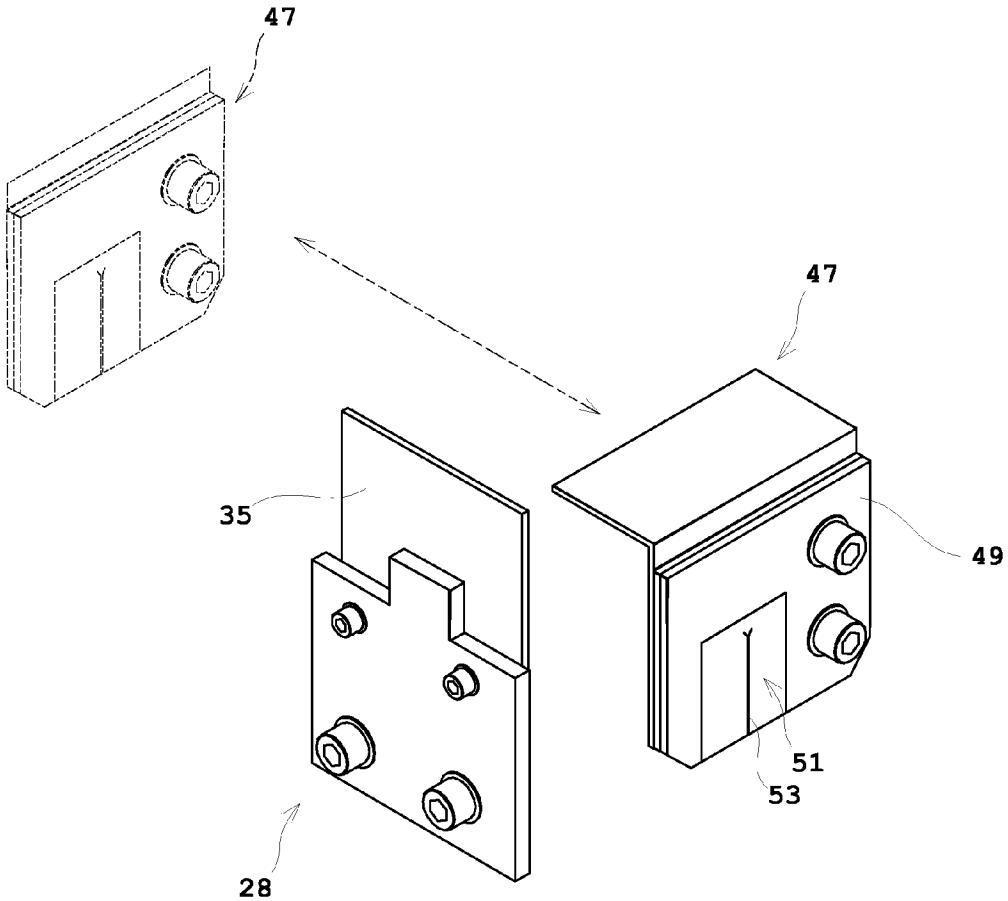
FIG. 4 is a perspective view schematically illustrating a wiper blade and a wiper cleaner unit.

Reference is now made to FIG. 4. FIG. 4 is a schematic perspective view of the wiper blade and the wiper cleaner unit.

The wiper-off part 47 includes a holder 49 and a wiper-off part member 51. The holder 49 holds the plate wiper-off part member 51 in such a way that the wiper-off part member 51 intersects the wiper blades 35 in plan view. The wiper-off part member 51 is made of resin, which is similar to the wiper blades 35. The wiper-off part member 51 has a slit 53 formed therein at a position where the wiper blades 35 are disposed in front view. The slit 53 is, for example, formed by a width smaller than a thickness of the wiper blades 35. Consequently, when the wiper cleaner unit 43 moves to the capping position in synchronization with the movement of the cap holder 31, the slit 53 of the wiper-off part member 51 squeezes the wiper blades 35, thereby removing the ink droplets and foreign substances on the wiper blades 35. The wiper-off part member 51 is made of resin, and the slit 53 thereof squeezes the wiper blades 35. This achieves removal of the ink droplets dried and solidified to some extent.

Figure 5:
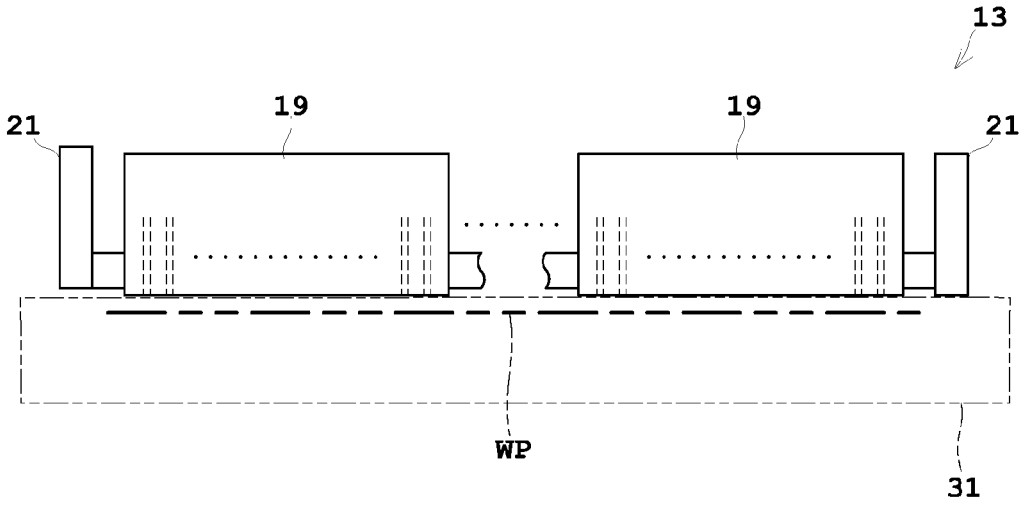
FIG. 5 is a front view of the print unit upon printing.
Figure 6:
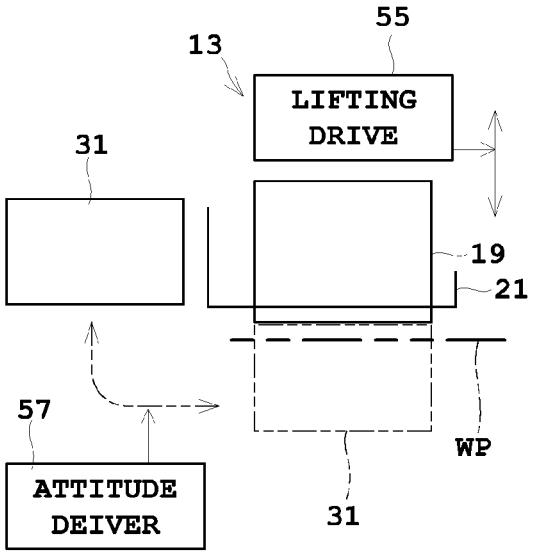
FIG. 6 is a side view of the print unit upon the printing.
Figure 7:
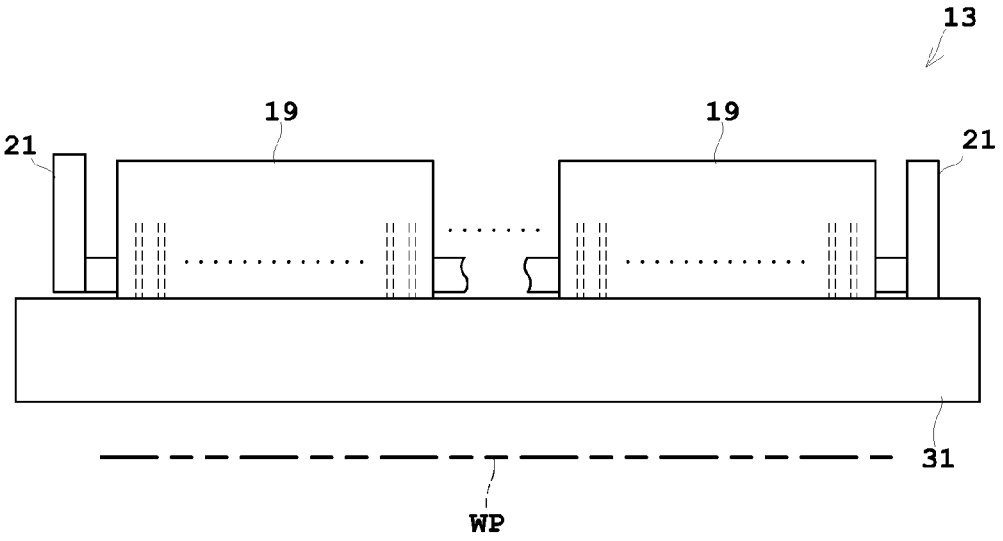
FIG. 7 is a front view of the print unit upon maintenance.
Figure 8:
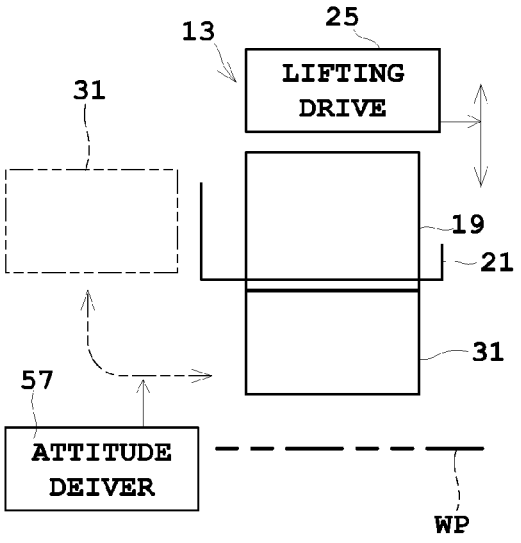
FIG. 8 is a side view of the print unit upon the maintenance.
Figure 9:
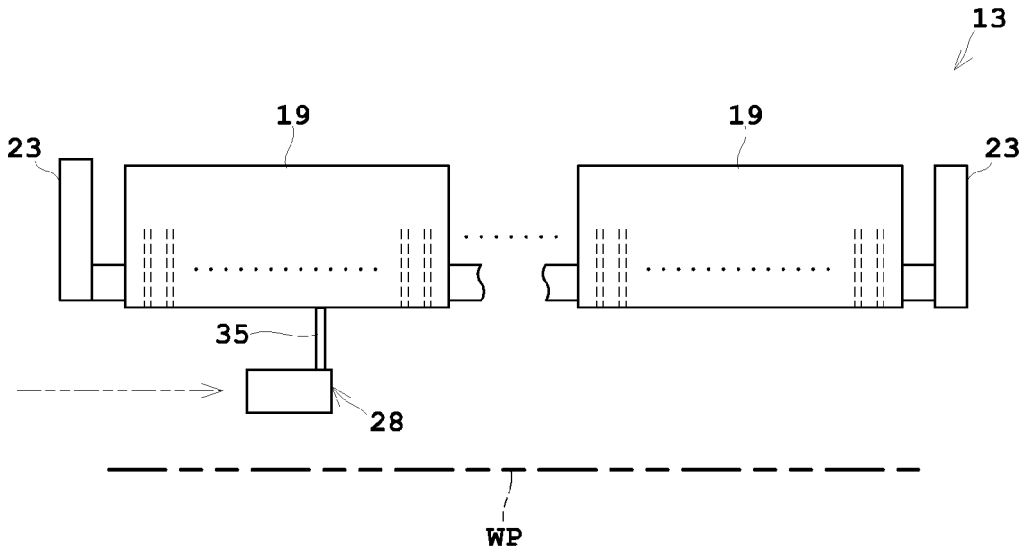
FIG. 9 is a front view of the print unit upon wiping off with a wiper unit.
Figure 10:
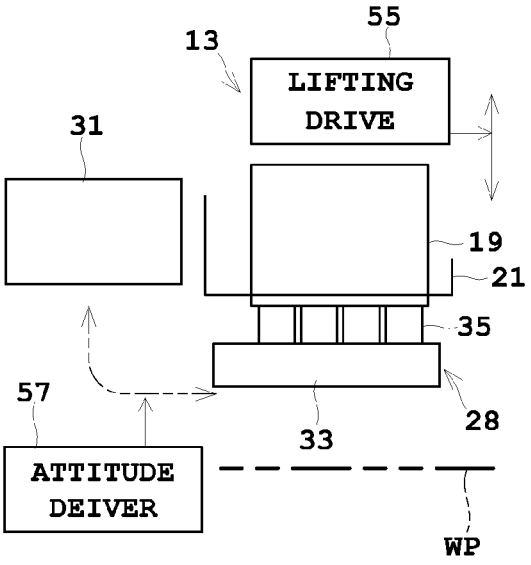
FIG. 10 is a side view of the print unit upon wiping off with the wiper unit.

Now reference is made to FIGS. 5 to 10. FIG. 5 is a schematic front view of the print unit upon printing. FIG. 6 is a schematic side view of the print unit upon printing. FIG. 7 is a schematic front view of the print unit upon maintenance. FIG. 8 is a schematic side view of the print unit upon the maintenance. FIG. 9 is a schematic front view of the print unit upon wiping with the wiper unit. FIG. 10 is a schematic side view of the print unit upon wiping with the wiper unit.

The inkjet head holder 21 holding the inkjet heads 19 is vertically movable with a lifting driver 55 formed by the motors 27 and the like. Specifically, the inkjet head holder 21 is movable between the "printing position" in FIGS. 5 and 6 and the "maintenance position" in FIGS. 7 and 8. As illustrated in FIGS. 5 and 6, the printing position is a level where the discharge surfaces of the inkjet heads 19 approach the top face of the web paper WP. In contrast to this, the maintenance position is a level where the discharge surfaces of the inkjet heads 19 are above the printing position and are largely spaced away from the top face of the web paper WP.

The cap holder 31 is moved by an attitude driver 57 as under. That is, the cap holder 31 is lifted vertically while moving to a front side and a back side of the inkjet head holder 21 in accordance with vertical movement of the inkjet head holder 21 between the printing position and the maintenance position. Specifically, when the inkjet head holder 21 is located at the printing position in FIGS. 5 and 6, the cap holder 31 enters to the back side of the inkjet head holder 21 and is moved to the "standby position" higher than the discharge surfaces of the inkjet heads 19. When the inkjet head holder 21 is located at the maintenance position in FIGS. 7 and 8, the cap holder 31 is moved to the "capping position" between the discharge surfaces of the inkjet heads 19 and the web paper WP. At this time, the wiper cleaner unit 43 is moved in synchronization with the movement of the cap holder 31 to the capping position, whereby the wiper-off part 47 wipes off the wiper blades 35.

The cap holder 31 and the attitude driver 57 correspond to the "wiper cleaner unit driving device" in the present invention.

At the maintenance position, moving the motor 39 allows reciprocation of the wiper unit 28 in the standby position in FIGS. 2 and 3 along the discharge surfaces of the inkjet heads 19 in the width direction of the web paper WP, as illustrated in FIGS. 9 and 10. This yields removal of ink droplets and foreign substances on the discharge surfaces of the inkjet heads 19 through purge and the like using the wiper blades 35. On the other hand, this causes adhesion of the ink droplets and the foreign substances to the wiper blades 35, the ink droplets and the foreign substances being removed from the discharge surfaces of the inkjet heads 19.

After the wiper unit 28 returns to the standby position, the wiper cleaner unit 43 operates while the inkjet head holder 21 is disposed in the maintenance position and the cap holder 31 in the standby position. Specifically, the cap holder 31 is moved to the capping position between the discharge surfaces of the inkjet heads 19 and the web paper WP. This operates the wiper cleaner unit 43 in synchronization with the cap holder 31, and causes the wiper-off part 47 to move from the position in FIG. 2 denoted by chain double-dashed line to the position in FIG. 2 denoted by solid lines. Accordingly, the wiper-off part member 51 squeezes the wiper blades 35 in the standby position, thereby removing the ink droplets and the foreign substances on the wiper blades 35.

With the embodiment of the present embodiment, the wiper cleaner unit 43 moves the wiper-off part 47 to the capping position orthogonally relative to the direction in which the inkjet heads 19 are disposed in synchronization with movement of the cap holder 31, thereby wiping off the wiper blades 35 in the standby position orthogonally relative to the direction in which the inkjet heads 19 are disposed. This allows the wiper-off part 47 to clean the wiper blades 35 off the ink droplets. Consequently, cleaning unevenness of the print unit 13 due to the wiper blades 35 is avoidable. As a result, reduction in frequency of cleaning and maintenance for the wiper blades is obtainable, resulting in expected enhanced apparatus availability.

The present invention is not limited to the foregoing examples, but may be modified as follows.

(1) In the embodiment mentioned above, the wiper-off part member 51 is a resin plate. However, this is not limitative in the present invention. For instance, the wiper-off part member 51 may be formed as under.

Figure 11:
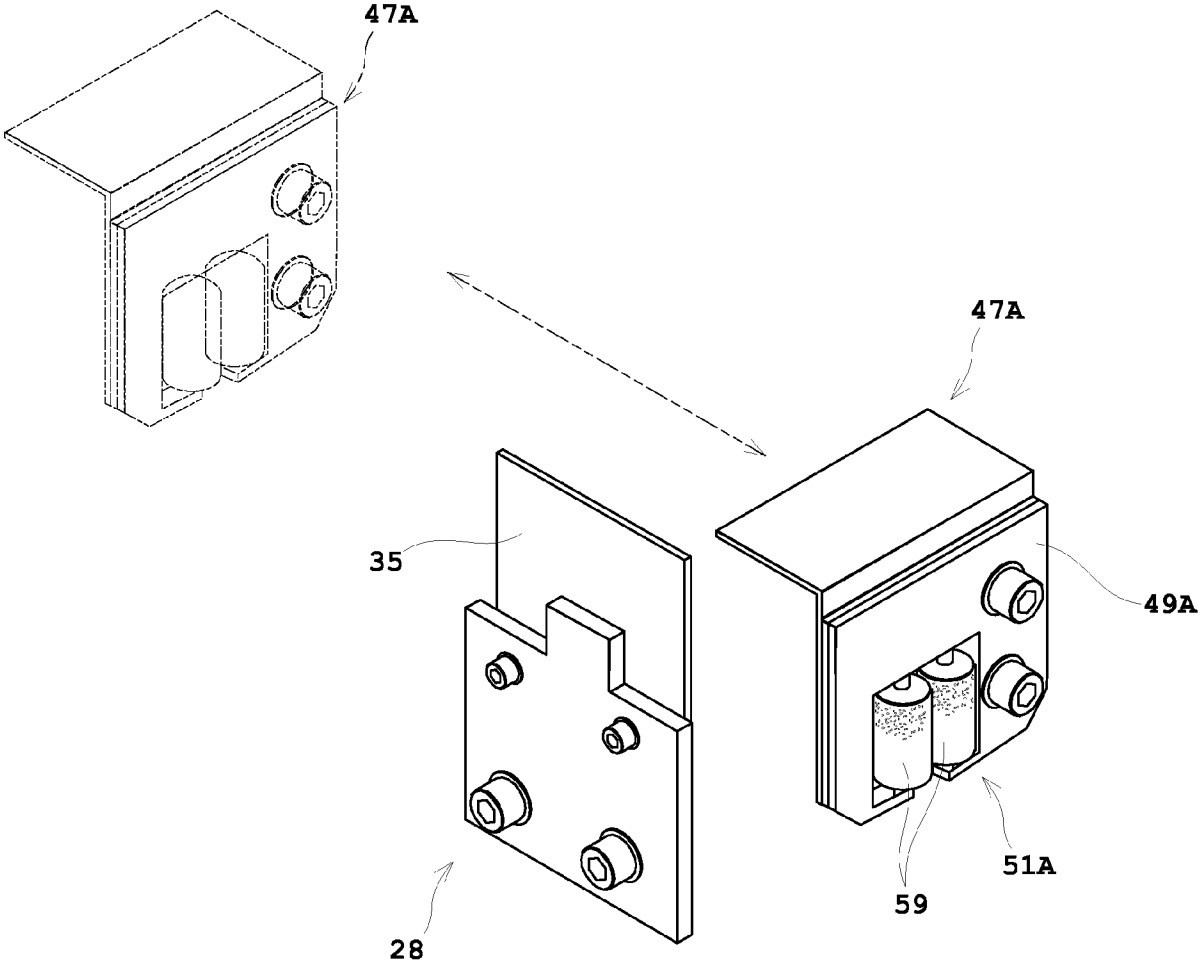
FIG. 11 is a perspective view of a wiper-off part according to one modification of the present invention.

Reference is now made to FIG. 11. FIG. 11 is a perspective view of a wiper-off part according to one modification of the present invention. The wiper-off part 47A includes a rotary wiper-off part member 51A. Specifically, the wiper-off part member 51 is formed by a pair of wiper-off rollers 59 (corresponding to the "pair of rotary rollers" in the present invention). The paired wiper-off rollers 59 each have a vertical rotary shaft, and an outer circumference thereof is made of a material that absorbs the ink droplets. Examples of the material that absorbs the ink droplets include a sponge. The paired wiper-off rollers 59 are combined in such a way that the outer circumferences thereof contact to each other. Moreover, the paired wiper-off rollers 59 are attached to a holder 49A in such a way that the wiper blades 35 are located at a contact part on the outer circumferences.

With the modification, the ink droplets are removable under lowered contact resistance to the wiper blades 35. Consequently, both the wiper blades 35 and the wiper-off part 47A are worn less, achieving reduction in frequency for maintenance of the wiper blades 35 and the wiper-off part 47A. Moreover, the sponge made of a hygroscopic material absorbs the ink droplets, resulting in prevention of contamination on the apparatus due to drop off of the ink droplets.

(2) In the embodiment mentioned above, the wiper cleaner unit 43 is moved in synchronization with the cap holder 31 and the attitude driver 57. However, this is not limitative in the present invention, but may be formed as under.

Figure 12:
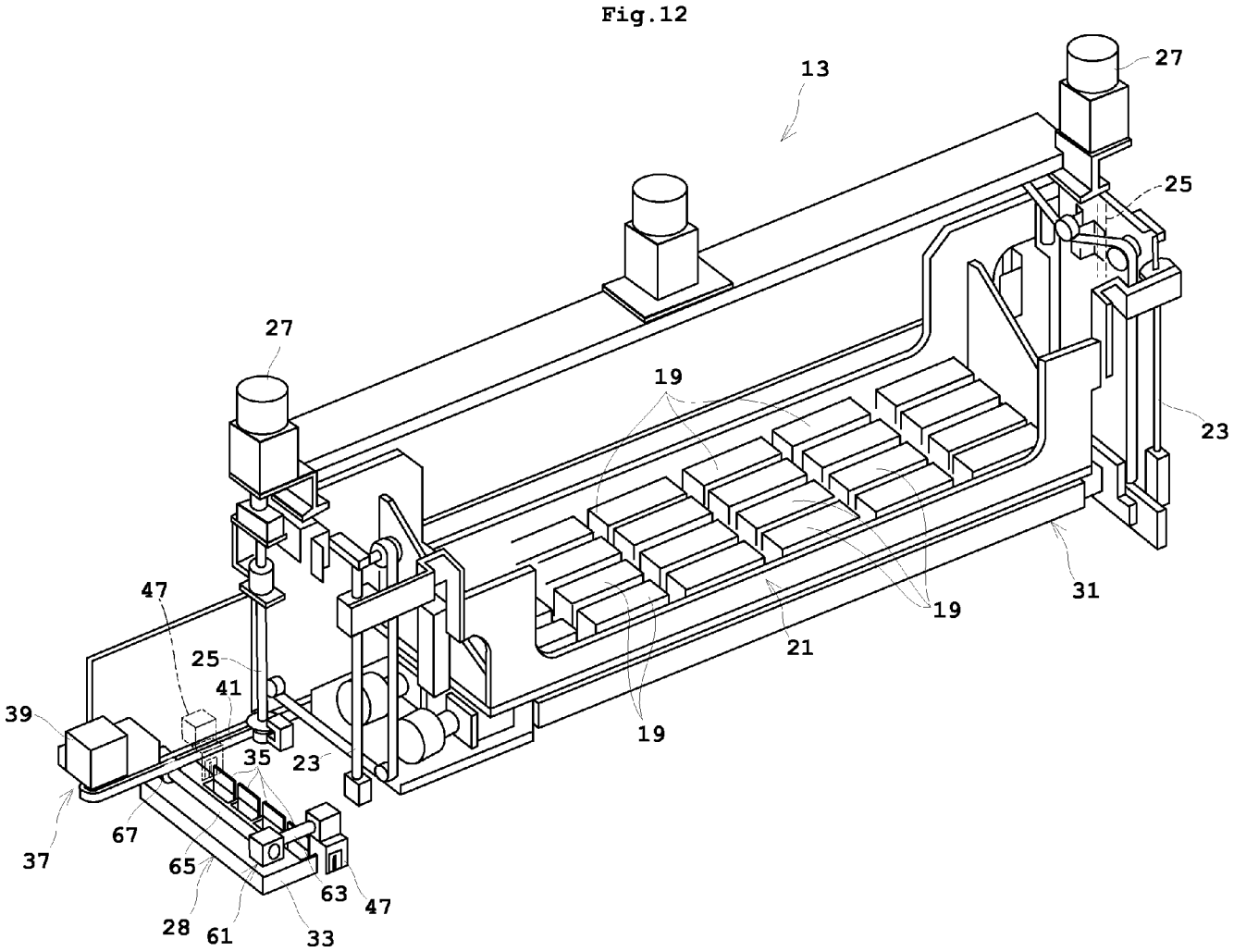
FIG. 12 is a perspective view of a wiper cleaner unit according to the modification.

Reference is now made to FIG. 12. FIG. 12 is a perspective view illustrating a wiper cleaner unit according to one modification of the present invention. The modification differs from the above embodiment in that a wiper-off part 47 is not coupled to the cap holder 31. A wiper cleaner unit drive unit 61, corresponding to the "wiper cleaner unit driving device" in the present invention, includes a holder 63, a ball screw 65, and a motor 67. The holder 63 has a proximal end face on which the ball screw 65 is screwed, and has a front end face to which the wiper-off part 47 is attached. The ball screw 65 is disposed horizontally above a base 33, and has a long axis along a transportation direction of the web paper WP. The ball screw 65 has a proximal end face to which a rotary shaft of the motor 67 is connected. Accordingly, rotating the motor 67 causes the holder 63 to move along the ball screw 65 and causes the wiper-off part 47 to wipe off the wiper blades 35.

With the above modification, the wiper cleaner unit drive unit 16 can adjust a wiping timing to a desired timing with the wiper-off part 47.

(3) The above embodiment and modifications each have described the inkjet printing apparatus 3 that performs printing onto the web paper WP in a roll form as one example. However, in the present invention, the print medium is not limited to the web paper WP. Examples of other types of the print medium include a printing film.

REFERENCE SIGNS LIST

WP . . . web paper
1 . . . paper feeder
3 . . . inkjet printing apparatus
5 . . . take-up roller
19 . . . inkjet head
21 . . . inkjet head holder
28 . . . wiper unit
29 . . . cap
31 . . . cap holder
33 . . . base
35 . . . wiper blade
37 . . . wiper drive unit
45 . . . coupling member
47 . . . wiper-off part
51 . . . wiper-off part member
53 . . . slit
55 . . . lifting driver
57 . . . attitude driver

The invention claimed is:

1. An inkjet printing apparatus that discharges ink droplets to a print medium for printing, the inkjet printing apparatus comprising:

a printing head that has a plurality of inkjet heads disposed in a direction orthogonal to a transportation direction in which the printing head is moved relatively to the print medium, and discharges the ink droplets from discharge surfaces of the inkjet heads to the print medium individually for the printing;

a cap unit movable in the transportation direction between a capping position for closing a discharge surface of the printing head and a standby position for opening the discharge surface of the printing head;

a wiper unit that has wiper blades in a direction orthogonal to a direction in which the inkjet heads are disposed, and moves from the standby position, spaced away from the printing head, in the direction in which the inkjet heads are disposed for wiping off the discharge surfaces of the inkjet heads with the wiper blades; and a wiper cleaner unit that is coupled to the cap unit and is provided with a wiper-off part that wipes off the wiper blades in the standby position to the transportation direction by moving to the transportation direction in synchronization with movement of the cap unit to the capping position in the transportation direction.

2. The inkjet printing apparatus according to claim 1, wherein the wiper cleaner unit is attached and fixed to the cap unit.

3. The inkjet printing apparatus according to claim 1, wherein the wiper-off part includes a slit slightly narrower than a thickness of the wiper blades in the direction in which the inkjet heads are disposed, and the slit squeezes the wiper blades.

4. The inkjet printing apparatus according to claim 1, wherein the wiper-off part includes a pair of rotary rollers into which the wiper blades are interposed in the direction in which the inkjet heads are disposed, and the pair of rotary rollers wipes off the wiper blades.

5. The inkjet printing apparatus according to claim 1, wherein the wiper-off part is made of a hygroscopic material that absorbs the ink droplets discharged from the inkjet heads.

6. The inkjet printing apparatus according to claim 2, wherein the wiper-off part includes a slit slightly narrower than a thickness of the wiper blades in the direction in which the inkjet heads are disposed, and the slit squeezes the wiper blades.

7. The inkjet printing apparatus according to claim 2, wherein the wiper-off part includes a pair of rotary rollers into which the wiper blades are interposed in the direction in which the inkjet heads are disposed, and the pair of rotary rollers wipes off the wiper blades.

8. The inkjet printing apparatus according to claim 2, wherein the wiper-off part is made of a hygroscopic material that absorbs the ink droplets discharged from the inkjet heads.

9. The inkjet printing apparatus according to claim 3, wherein the wiper-off part is made of a hygroscopic material that absorbs the ink droplets discharged from the inkjet heads.

10. The inkjet printing apparatus according to claim 4, wherein the wiper-off part is made of a hygroscopic material that absorbs the ink droplets discharged from the inkjet heads.

11. The inkjet printing apparatus according to claim 6, wherein the wiper-off part is made of a hygroscopic material that absorbs the ink droplets discharged from the inkjet heads.

12. The inkjet printing apparatus according to claim 7, wherein the wiper-off part is made of a hygroscopic material that absorbs the ink droplets discharged from the inkjet heads.

* * * * *